US007717758B2

(12) United States Patent
Fukamachi

(10) Patent No.: US 7,717,758 B2
(45) Date of Patent: May 18, 2010

(54) CONNECTOR WITH RETAINER AND RETAINER LOCKING SURFACES ALIGNED OBLIQUE TO MOVEMENT DIRECTION OF RETAINER

(75) Inventor: Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/419,468

(22) Filed: Apr. 7, 2009

(65) Prior Publication Data

US 2009/0291599 A1 Nov. 26, 2009

(30) Foreign Application Priority Data

May 22, 2008 (JP) ..... 2008-133901

(51) Int. Cl.
*H01R 13/514* (2006.01)

(52) U.S. Cl. ..... 439/752; 439/595

(58) Field of Classification Search ..... 439/595, 439/752, 752.5

See application file for complete search history.

(56) References Cited

U.S. PATENT DOCUMENTS

| | | | | |
|---|---|---|---|---|
| 6,280,262 | B1 * | 8/2001 | Tanaka | 439/752 |
| 7,001,206 | B2 * | 2/2006 | Sakurai et al. | 439/489 |
| 7,056,159 | B2 | 6/2006 | Fukatsu et al. | |
| 7,204,726 | B2 * | 4/2007 | Yamashita et al. | 439/752 |

* cited by examiner

*Primary Examiner*—Thanh-Tam T Le
(74) *Attorney, Agent, or Firm*—Gerald E. Hespos; Michael J. Porco

(57) ABSTRACT

A connector has a retainer (40) mounted on a housing (10) for movement between a temporary locking position and a main locking position in a direction (Y) oblique to a fit-in direction (X) of the housing (10). Terminal fittings (70) can be inserted into the housing (10) when the retainer (40) is at the temporary locking position and are locked in housing (10) when the retainer (40) is at the main locking position. The housing (10) has a locking part (28) and the retainer (40) has a to-be-locked portion (52) that can be locked together. Locking surfaces of the locking part (28) and the to-be-locked portion (52) are inclined to the movement direction (Y) of the retainer (40) and to the fit-in direction (X) of the housing (10).

8 Claims, 10 Drawing Sheets

CONNECTOR WITH RETAINER AND RETAINER LOCKING SURFACES ALIGNED OBLIQUE TO MOVEMENT DIRECTION OF RETAINER

BACKGROUND OF THE INVENTION

1. Field of the Invention

The invention relates to a connector.

2. Description of the Related Art

U.S. Pat. No. 7,056,159 describes a connector with a housing that can be fit in a mating housing and a retainer that is mounted in a retainer insertion hole formed in the housing. The retainer can be moved in the retainer mount hole between a temporary locking position and a main locking position along a direction that extends oblique to the fit-in direction of the housing. Terminal fittings can be inserted into the housing and removed therefrom when the retainer is disposed at the temporary locking position. However, the retainer prevents the removal of the terminal fittings from the housing when the retainer is at the main locking position. The housing has a locking part and the retainer has a to-be-locked portion that can be locked to the locking part. The locking part and the to-be-locked portion are locked to each other at the main locking position along the fit-in direction of the housing.

The electric wire connected with the terminal fitting may be pulled rearward when the retainer is at the main locking position and may exert a separation force that urges the retainer obliquely toward the temporary locking position. At this time, the direction in which the retainer separates from the housing is almost coincident with the direction in which the locking part and the to-be-locked portion are locked together, even though the retainer deviates to a low extent from the direction in which the locking part and the to-be-locked portion are locked to each other. Thus, there is a fear that the to-be-locked portion will unlock from the locking part if the separation force applied to the retainer is excessively large, and hence the retainer may be removed inadvertently from the housing.

The invention has been completed in view of the situation described above. Therefore it is an object of the invention to provide a connector in which a retainer can be prevented from being inadvertently removed from a housing.

SUMMARY OF THE INVENTION

The invention relates to a connector including a housing that can be fit in a mating housing. A retainer is mounted on the housing and can move in a direction oblique to a fit-in direction of the housing between temporary and main locking positions. Terminal fittings can be inserted into the housing and removed therefrom when the retainer is at the temporary locking position. However, the retainer prevents removal of the terminal fittings from the housing when the retainer is at the main locking position.

The housing has at least one locking part and the retainer has at least one to-be-locked portion that locks with the locking part when the retainer is at the main locking position. The locking part and the to-be-locked portion preferably incline toward a direction perpendicular to the movement direction of the retainer with respect to the fit-in direction of the housing. Therefore, the to-be-locked portion is not easily unlocked from the locking part when an electric wire connected with a terminal fitting is pulled rearward in the fit-in direction of the housing. Accordingly, the retainer is not likely to be separated inadvertently from the housing.

The to-be-locked portion preferably is in the vicinity of an edge of the retainer and inclines in a direction in which a distance between the to-be-locked portion and the edge of the retainer gradually increases from one end of the to-be-locked portion to the other end thereof. Thus, a thick region is formed between the upper edge of the to-be-locked portion and the edge of the retainer. The thick region protects the to-be-locked portion and enhances the strength of the to-be locked portion even though the to-be-locked portion is near the edge of the retainer.

The locking part and the to-be-locked portion preferably are locked to each other at the main locking position with the locking part and the to-be-locked portion inclining in a direction that is not perpendicular to the movement direction of the retainer. Therefore this construction is applicable to a situation in which the locking part and the to-be-locked portion cannot be locked to each other along the direction perpendicular to the movement direction of the retainer.

A retainer insertion hole is formed through a first surface of the housing that confronts a direction in which the retainer is mounted on the housing and through both side surfaces of the housing adjacent to the first surface. The retainer has a base part and two side plates project up from widthwise ends of the base part. The side plates are configured to cover a portion of the retainer insertion hole formed through the side surfaces of the housing and a periphery thereof. To-be-locked portions are disposed on an inner surface of each of the side plates of the retainer and locking parts are on the periphery of the retainer insertion hole. Thus, the locking part and the to-be-locked portion are locked together over a large area.

The locking part and the to-be-locked portion are locked together at the main locking position with the locking part and the to-be-locked portion inclining in a direction perpendicular to the movement direction of the retainer. This construction reliably prevents the to-be-locked portion from being unlocked from the locking part.

DETAILED DESCRIPTION OF THE PREFERRED EMBODIMENTS

A connector in accordance with the invention includes a housing 10, a retainer 40, and terminal fittings 70 as illustrated in FIGS. 1 through 10.

Figure 3:
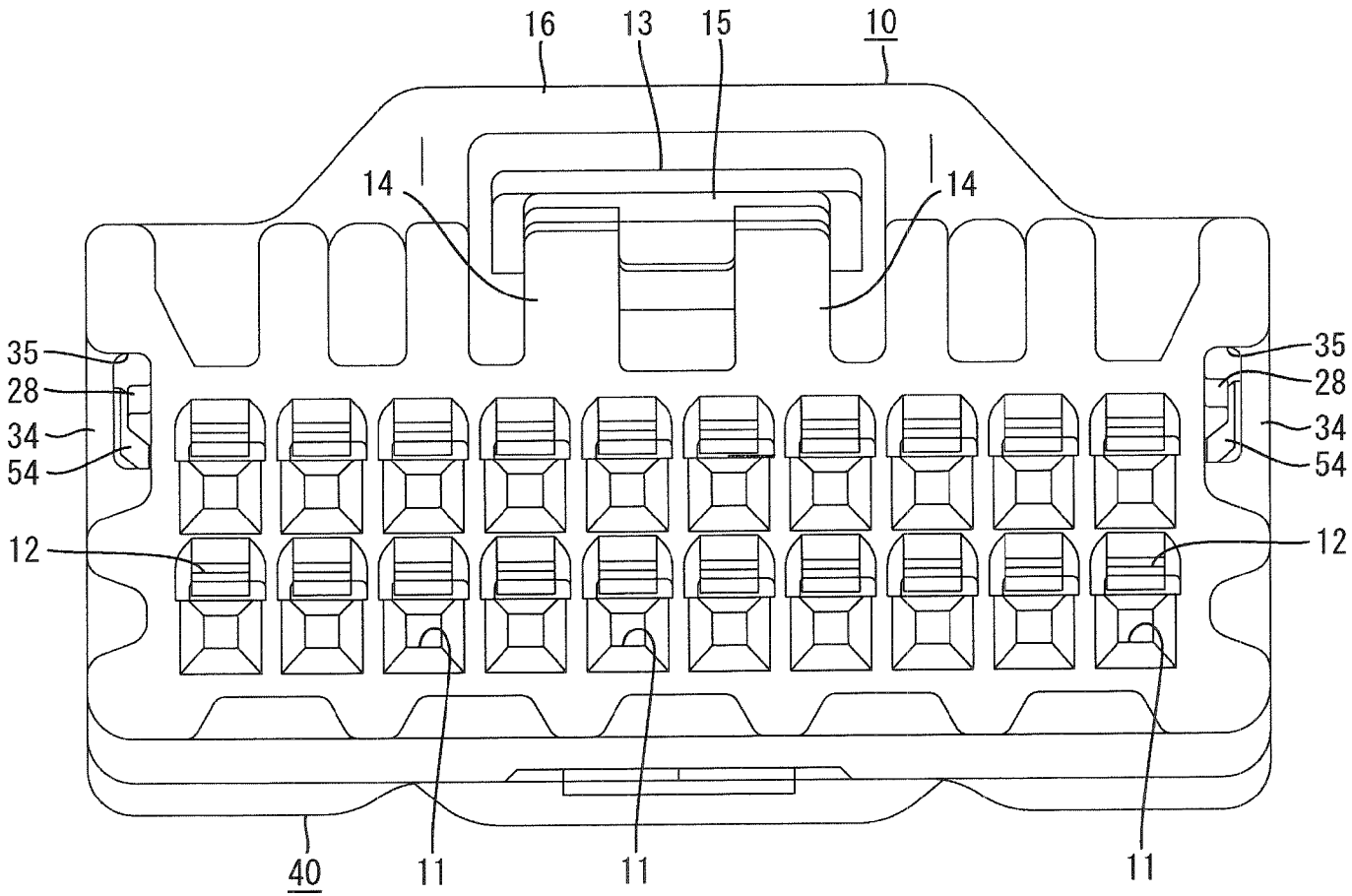
FIG. 3 is a front view showing a state in which the retainer is located at the temporary locking position.
Figure 9:
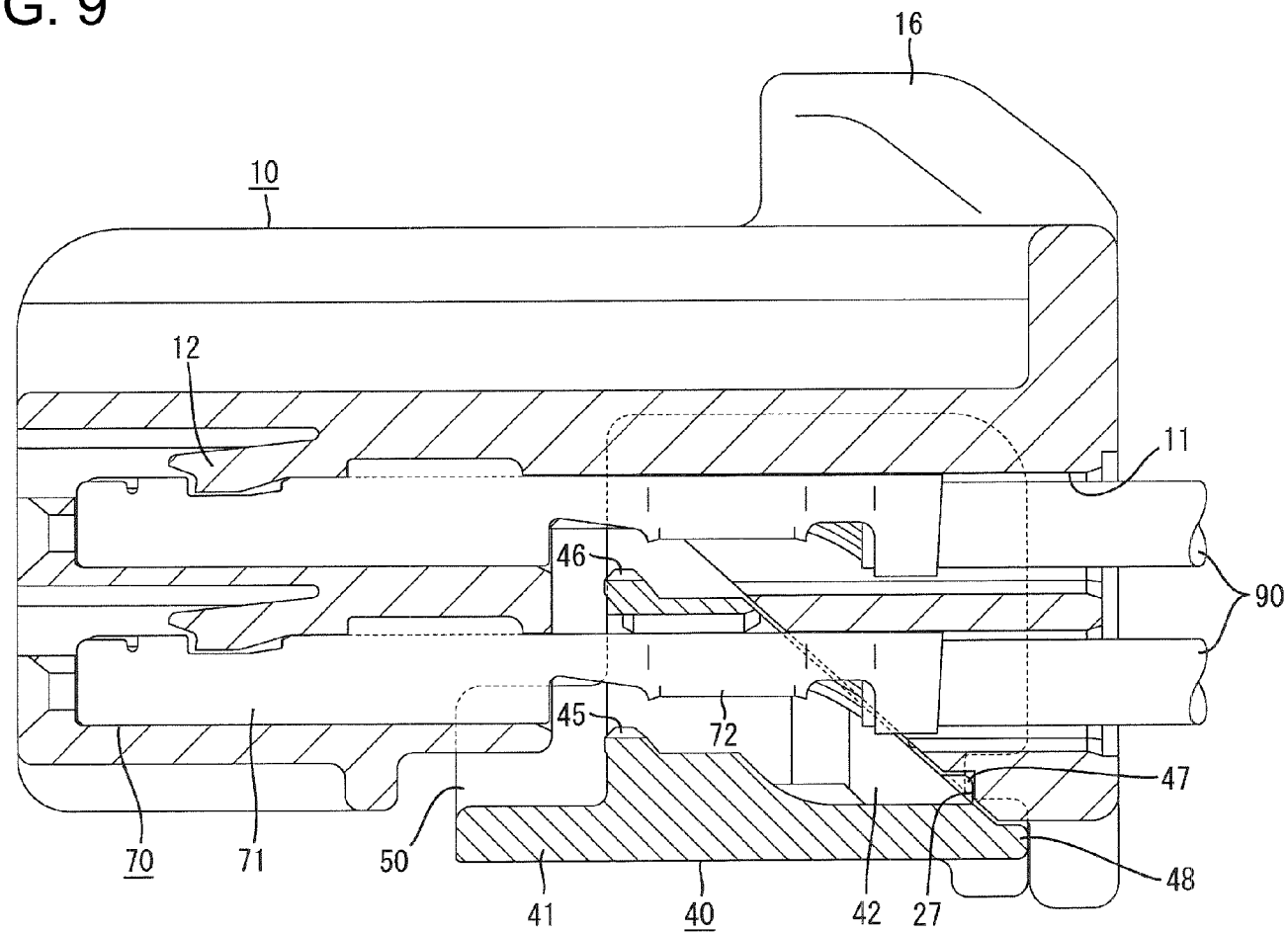
FIG. 9 is a sectional side elevation showing terminal fittings inserted into the housing when the retainer is at the temporary locking position.

The housing 10 is made of synthetic resin and defines a substantially block-shape. Cavities 11 penetrate through the housing 10 in the longitudinal direction of the housing 10, as shown in FIG. 9, and each cavity 11 is capable of accommodating a terminal fitting 70 therein. The cavities 11 are arranged in two stages in the height direction of the housing 10 and in plural rows in a left-to-right or widthwise direction thereof. A flexible lance 12 is provided on an inner surface of each cavity 11 to prevent removal of the terminal fitting 70. A locking arm 13 is provided at a widthwise central portion of an upper surface of the housing 10, as shown in FIG. 3, and functions to hold a mating housing (not shown) in a fit-in state. The locking arm 13 has two legs 14 that are spaced apart in the widthwise direction of the housing 10 and an arm body 15 extends rearward from the legs 14. The arm body 15 deforms elastically on both legs 14 in the height direction of the housing 10 for locking the mating housing thereto. A bridge 16 covers the periphery of a rear end of the arm body 15 at a rear end of the upper surface of the housing 10. The bridge 16 prevents the lock arm 13 from being inadvertently operated in a way that could unlock the mating housing.

Figure 1:
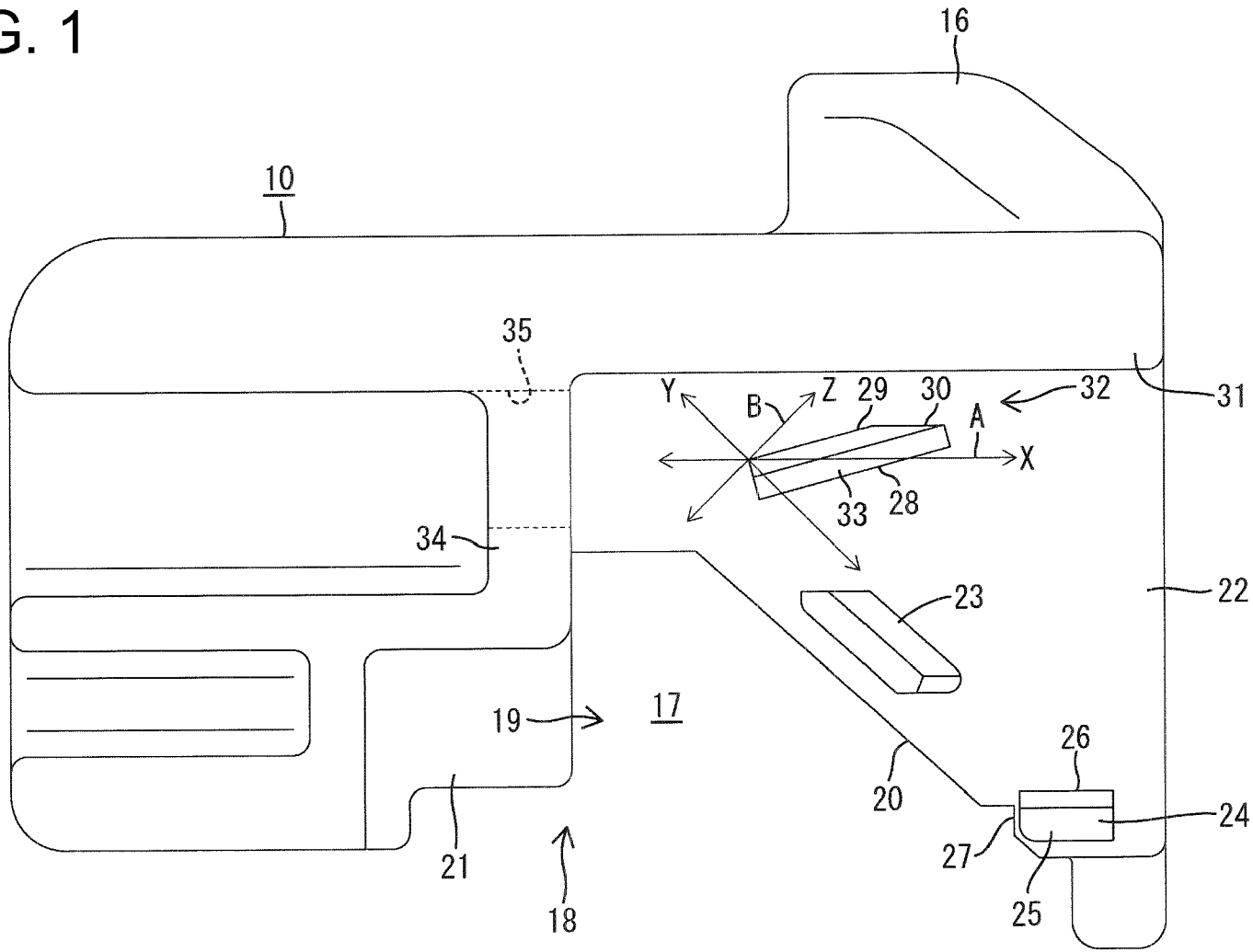
FIG. 1 is a side view showing a housing of a connector in accordance with the invention.

A retainer insertion hole 17 extends into the housing 10, as shown in FIG. 1, and communicates with all of the cavities 11. The retainer insertion hole 17 includes a retainer insertion port 18 formed through a lower surface of the housing 10 and two side openings 19 formed through the opposite respective side surfaces of the housing 10. Thus, the retainer insertion hole 17 is open through three adjacent surfaces. A rear of the retainer insertion hole 17 includes an inclined surface 20 that inclines obliquely down toward the rear of the housing 10. The retainer 40 is movable along the inclined surface 20 in an oblique direction Y with respect to the longitudinal fit-in direction X of the housing 10.

Front and rear concavities 21 and 22 are formed on each side surface of the housing 10 on the periphery of the respective opening 19. The front and rear concavities 21 and 22 are recessed inwardly from adjacent areas of the respective side surfaces of the housing 10. More specifically, the front concavity 21 is disposed forward from a lower portion of a front edge of the retainer insertion hole 17, whereas the rear concavity 22 is disposed rearward from the front edge of the retainer insertion hole 17 and continues to a rear surface of the housing 10. A guide 23 projects from the rear concavity 22 and extends substantially parallel to a rear edge of the retainer insertion hole 17. A removal prevention part 24 projects from the rear concavity 22 in a position near a rear edge of a lower end of the retainer insertion hole 17 and prevents removal of the retainer 40 from a temporary locking position thereof. A guide surface 25 extends along a lower surface of the removal prevention part 24 and inclines outward. A removal prevention surface 26 extends almost horizontally along an upper surface of the removal prevention part 24. A temporary locking part 27 is formed by cutting out the inclined surface 20 of the retainer insertion hole 17 and prevents the retainer 40 from moving to a main locking position. The temporary locking part 27 is disposed immediately forward from the removal prevention part 24.

A locking part 28 projects from the rear concavity 22 and prevents the retainer 40 from returning from the main locking position to the temporary locking position. The locking part 28 is rearward and upward from the upper edge of the retainer insertion hole 17 and inclines down toward the front of the housing 10. The locking part 28 is inclined to a direction Z that is perpendicular to a movement direction Y of the retainer 40 with respect to a fit-in direction X, and hence is not coincident with the direction Z. A locking surface 29 extends along the locking part 28 in the direction in which the locking part 28 extends. The locking surface 29 is in a region surrounded with a horizontal line A that extends along the fit-in direction X and an oblique line B that extends along the direction Z perpendicular to the movement direction Y of the retainer 40. An upper surface of the locking part 28 is defined by the locking surface 29 and a horizontal surface 30 continuous with a rear end of the locking surface 29. A beam 31 extends along the upper edge of the rear concavity 22 and a fit-in space 32 is defined between the beam 31 and the horizontal surface 30. The fit-in space 32 is approximately parallel with the beam 31. A guide slope 33 is formed along a lower surface of the locking part 28 for guiding the retainer 40 over the main locking position.

A protrusion 34 is disposed at approximately the center of each side surface of the housing 10 in the longitudinal direction thereof and defines a front end of the rear concavity 22. The protrusion 34 is continuous with the beam 31 and extends in the height direction of the housing 10 almost perpendicular to the beam 31. A through hole 35 is extends through the protrusion 34 at a longitudinal position forward of the locking part 28 and is formed during formation of the locking part 28. As shown in FIG. 3, the locking part 28 can be seen from the front end of the housing 10 through the through-hole 35.

Figure 5:
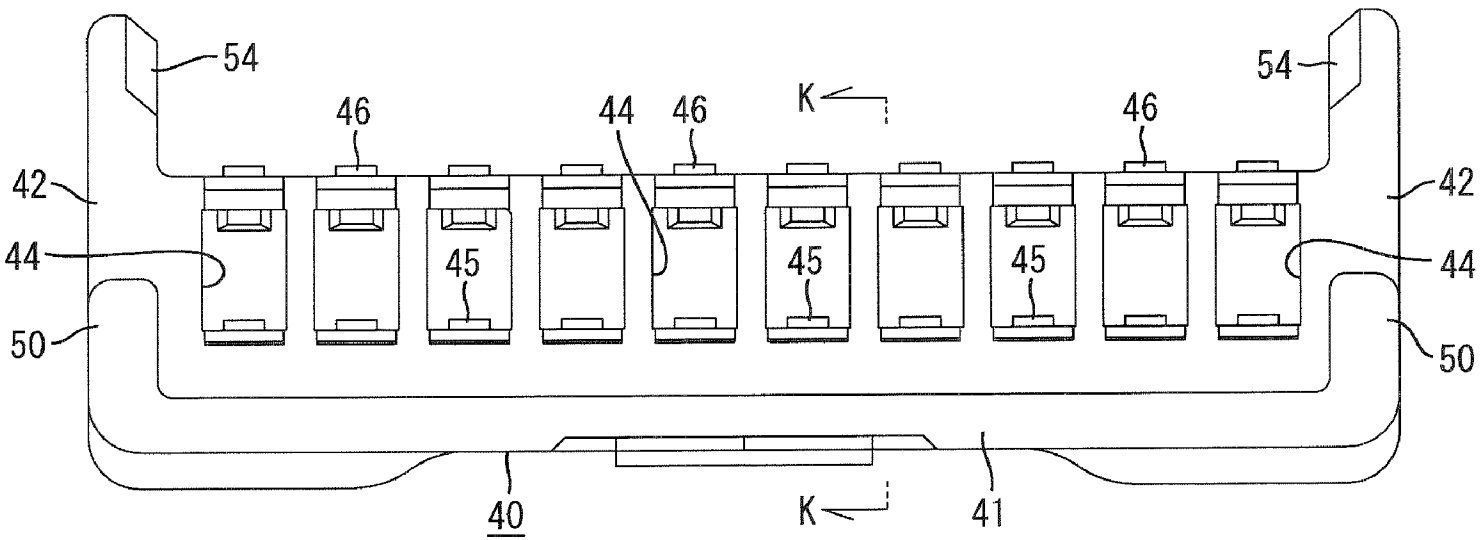
FIG. 5 is a front view showing the retainer.
Figure 6:
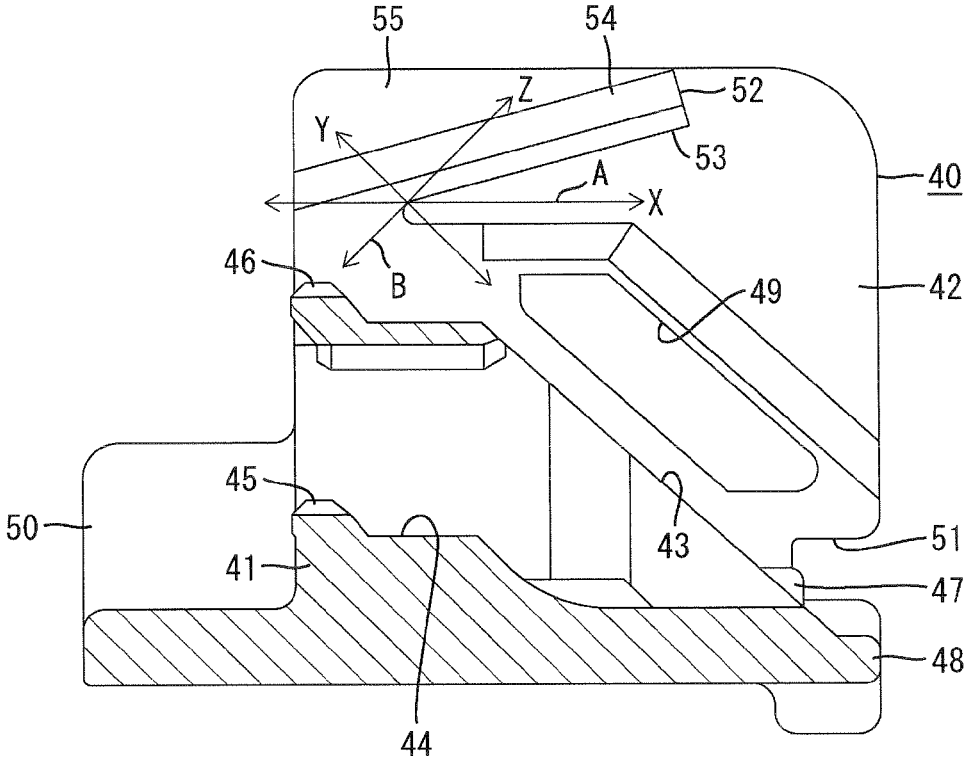
FIG. 6 is a sectional view taken along a line K-K of FIG. 5.
Figure 7:
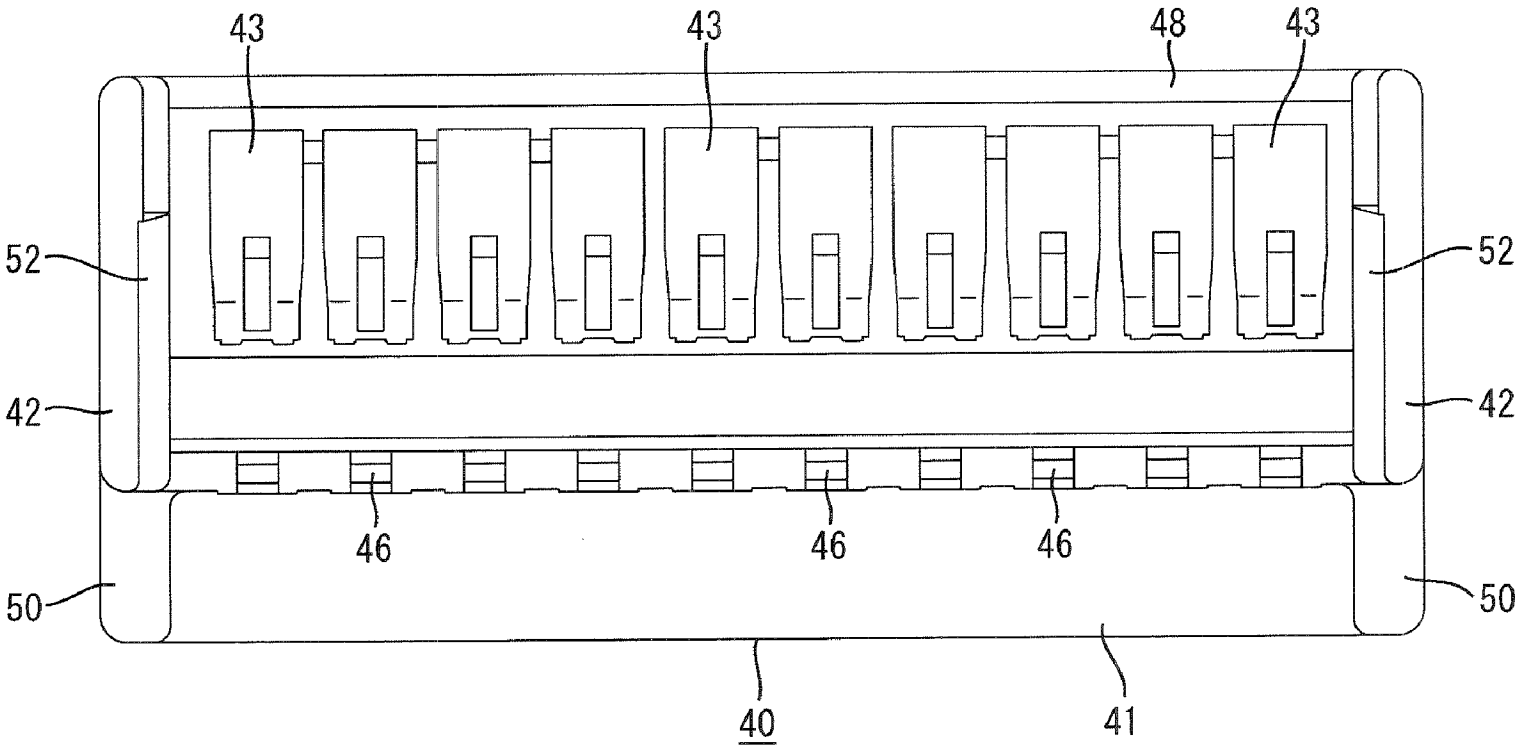
FIG. 7 is a plan view showing the retainer.

The retainer 40 also is made of synthetic resin and has a wide base 41 and two side plates 41 that extend up from both sides of the base 41, as shown in FIGS. 5 through 7. An inclined surface 43 is defined at the rear of the base 41 and inclines obliquely up to the front of the retainer 40. The retainer 40 is movable between the temporary locking position and main locking position in the oblique direction Y inclined with respect to the fit-in direction X of the housing 10. More particularly, the inclined surface 43 of the retainer 40 is slid in contact with the inclined surface 20 of the housing 10 as the retainer 40 is pressed obliquely up to the front from the temporary locking position to the main locking position and as the retainer 40 is pressed obliquely down to the rear from the main locking position to the temporary locking position. Insertion holes 44 for the terminal fittings 70 are formed through the base 41 at positions corresponding to the lower-stage cavities 11 at the main locking position. Lower locking projections 45 are formed at lower peripheries of the insertion holes 44 for preventing removal of the terminal fittings 70 from the lower-stage cavities. Upper locking projections 46 are formed at an upper edge of the base 41 for preventing removal of the terminal fittings 70 form the upper-stage cavities. A temporary to-be-locked projection 47 is formed on the inclined surface 43 of the base 41 and can be fit in and locked to the temporary locking part 27 at the temporary locking position. A thin fit-in piece 48 is formed at a rear end of the base part 41 and can be fit in the temporary locking part 27 at the main locking position. The thin fit-in piece 48 is continuous with a rear end of the fit-in piece 48.

Figure 10:
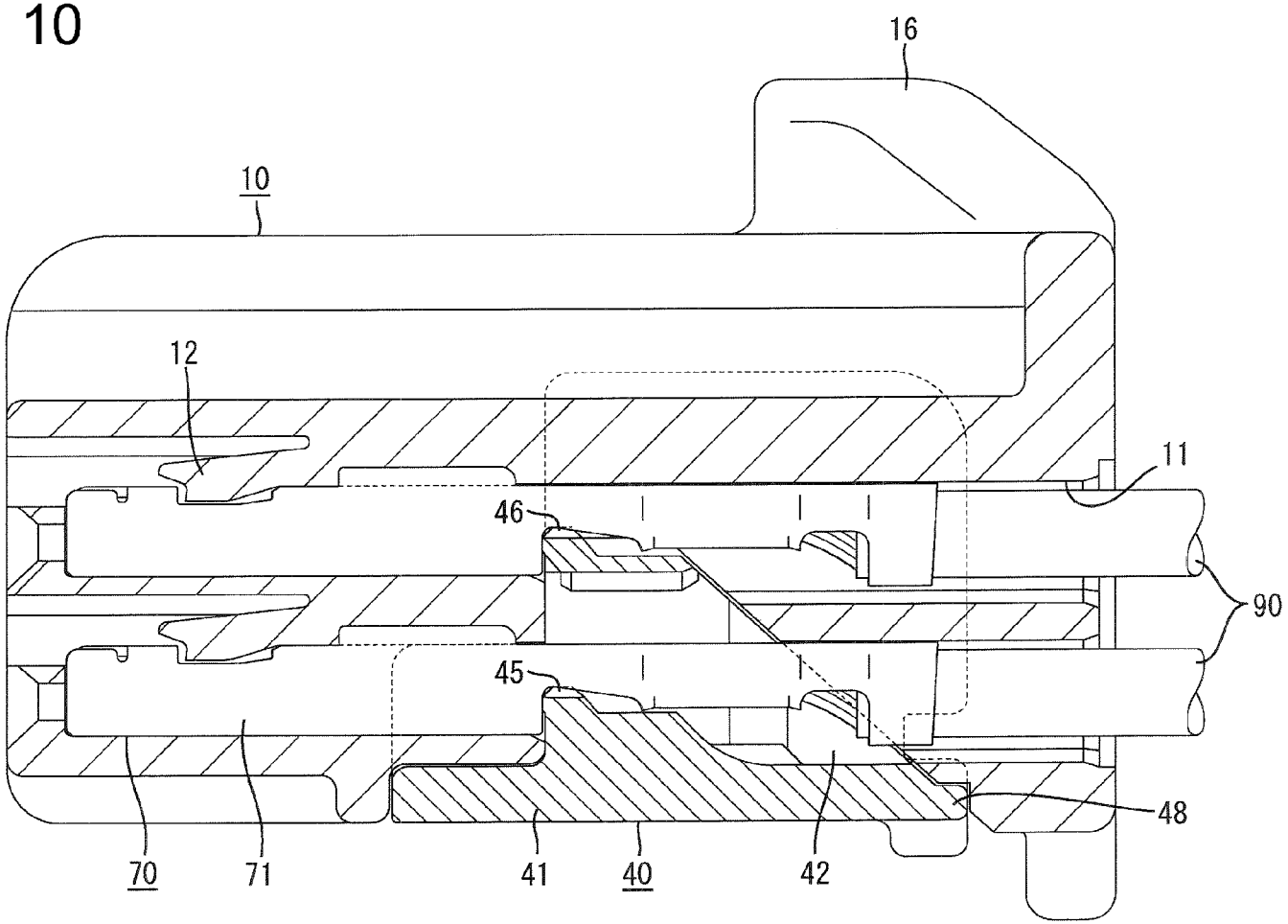
FIG. 10 is a sectional side elevation showing terminal fittings locked to the housing when the retainer is at the main locking position.

The lower and upper locking projections 45 and 46 are out of the cavities 11 at the temporary locking position, as shown in FIG. 9. Thus, the terminal fittings 70 can be inserted into and removed from the cavities 11 from the rear. The lower and upper locking projections 45 and 46 move into the cavities 11 at the main locking position, as shown in FIG. 10, for locking the rear ends of the terminal fittings 70 that have been inserted normally into the cavities 11 and preventing removal of the terminal fittings 70 from the cavities 11.

A guide hole 49 is formed through each side plate 42. The guide part 23 is fit in and slides along the guide hole 49 when the retainer 40 moves. A front plate 50 projects forward from a lower portion of a front edge of each side plate 42 and fits in the front concavity 21 at the main locking position. A notch 51 is formed by cutting out a lower part of a rear edge of each side plate part 42. The notch 51 receives the removal prevention part 24 and locks to the removal prevention surface 26 at the temporary locking position.

A to-be-locked projection 52 is formed on an inner surface of each side plate 42 at a position above the guide hole 49 and near an upper edge of each side plate 42 for locking to the locking part 28. The to-be-locked portion 52 inclines down toward the front of the retainer 40 at an acute angle to the direction Z that is perpendicular to the movement direction Y of the retainer 40 and at an acute angle to the fit-in direction X. Thus, the to-be-locked portion 52 is not coincident with the direction Z. A to-be-locked surface 53 is formed along the lower side of the to-be-locked portion 52 and extends along the extension direction of the to-be-locked portion 52. The to-be-locked surface 53 is in a region surrounded by the horizontal line A drawn along the fit-in direction X and the oblique line B drawn along the direction Z perpendicular to the movement direction Y of the retainer 40. A front end of the lower surface of the to-be-locked portion 52 is continuous with a projection of the periphery of the guide hole 49. A guide inclined surface 54 extends along the top of the to-be-locked portion 52 and guides the retainer 40 to the main locking position.

A rear end of the to-be-locked portion 52 is disposed on a level with the upper edges of both side plates 42. A front end of the to-be-locked portion 52 is approximately longitudinally coincident with front edges of both side plates 42 and is vertically spaced at a certain interval from the upper edge of both side plates 42. More specifically, the to-be-locked portion 52 inclines in a direction in which the distance between the to-be-locked portion 52 and the upper edges of both side plate parts 42 gradually increases from the rear of the to-be-locked portion 52 to the front thereof. A vertical triangular region 55 is formed between the upper edge of each side plate 42 and the upper edge of the to-be-locked portion 52. The region 55 fits in the fit-in space 32 of the housing 10 at the main locking position.

The terminal fitting 70 is formed by bending a conductive metal plate and has opposite front and rear ends. As shown in FIG. 9, a square tubular body 71 is formed at the front end of the terminal fitting 70 and an open barrel 72 is formed at the rear end. The body 71 receives a mating terminal fitting (not shown) accommodated in the mating housing and is connected therewith. The barrel 72 is crimped to an end of an electric wire 90 and connected therewith. The electric wires 90 connected with the terminal fittings 70 are pulled out rearward from the rear of the housing 10.

Figure 2:
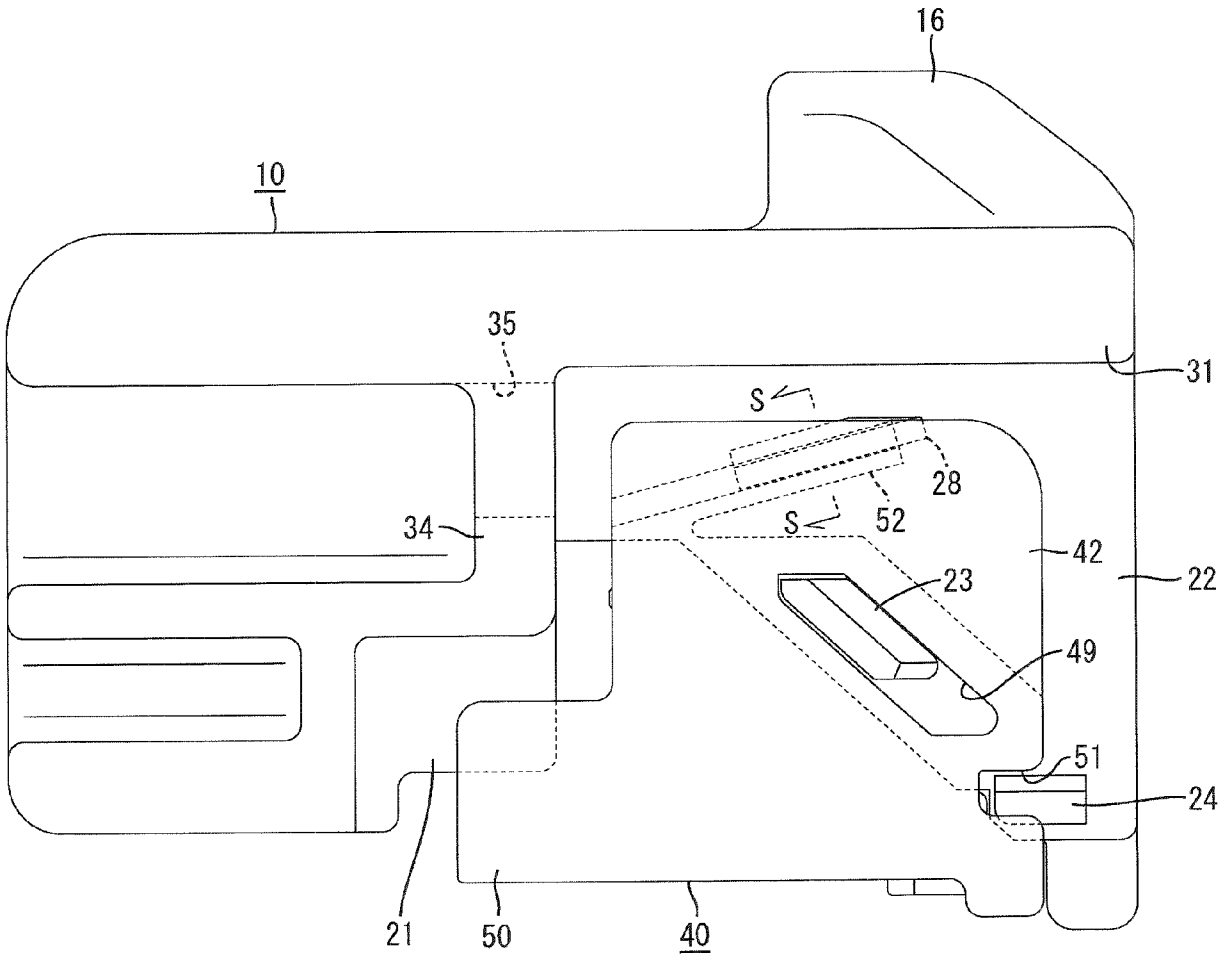
FIG. 2 is a side view showing a state in which a retainer is located at a temporary locking position.
Figure 8A:
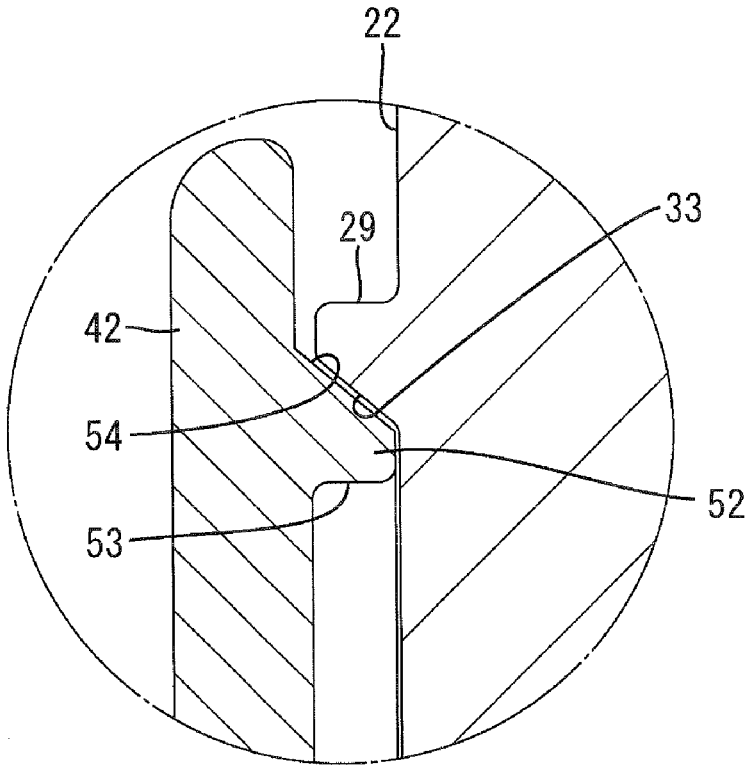
FIG. 8A is a sectional view taken along a line S-S of FIG. 2.

The retainer 40 is inserted into the retainer insertion hole 17 of the housing 10 through the retainer insertion port 18. As a result, the temporary locking part 27 and the temporary to-be-locked portion 47 are locked together, and the removal prevention part 24 and the to-be-locked portion 51 are locked together to hold the retainer 40 at the temporary locking position in a movement-prevented state. At this time, the inclined guide surface 54 of the to-be-locked portion 52 contacts the guide slope 33 of the locking part 28 from below, as shown in FIGS. 2 and 8A, to prevent the retainer 40 from moving to the main locking position. The terminal fittings 70 then are inserted into the respective cavities 11 from the rear, as shown in FIG. 9. Each of the elastic lances 12 deforms elastically during insertion of the respective terminal fitting 70, but then resiliently returns when the terminal fitting 70 has been inserted normally to achieve primary locking of the corresponding terminal fitting 70.

A force is applied to the retainer 40 to urge the retainer 40 obliquely up toward the front of the housing 10 after the terminal fittings 70 have been inserted. As a result, the temporary to-be-locked projection 47 is unlocked from the temporary locking part 27, and the inclined guide surface 54 and the guide slope 33 slide on each other. Thus, both side plate parts 42 deform out and allow the retainer 40 to move to the main locking position. One or more of the terminal fittings 70 may not have been inserted sufficiently into the cavity 11. However, the retainer 40 moves oblique to the fit-in direction X and forcibly moves any incompletely inserted terminal fitting 70 to the normal inserted state.

Figure 4:
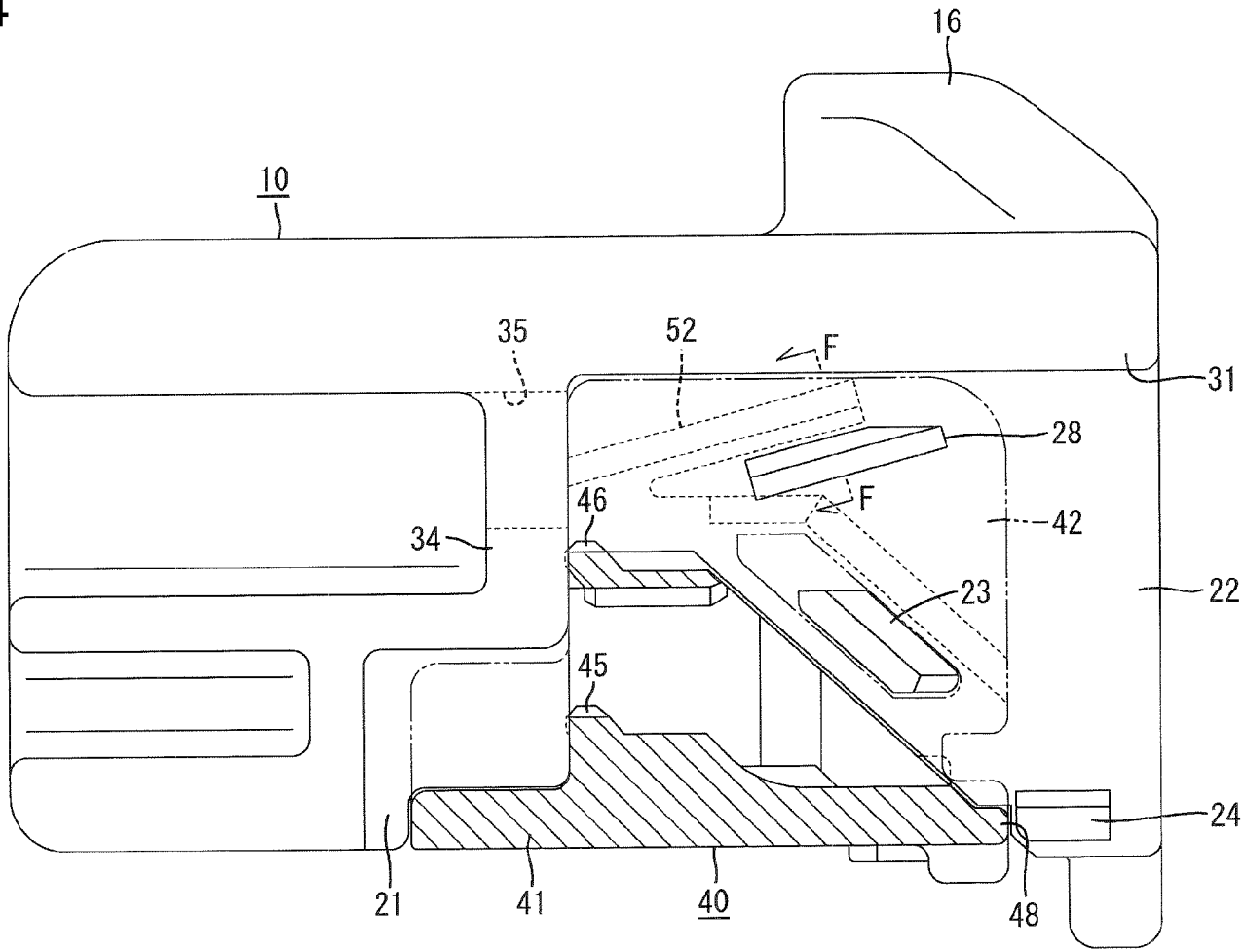
FIG. 4 is a side view partly in section showing a state in which the retainer is located at a main locking position.
Figure 8B:
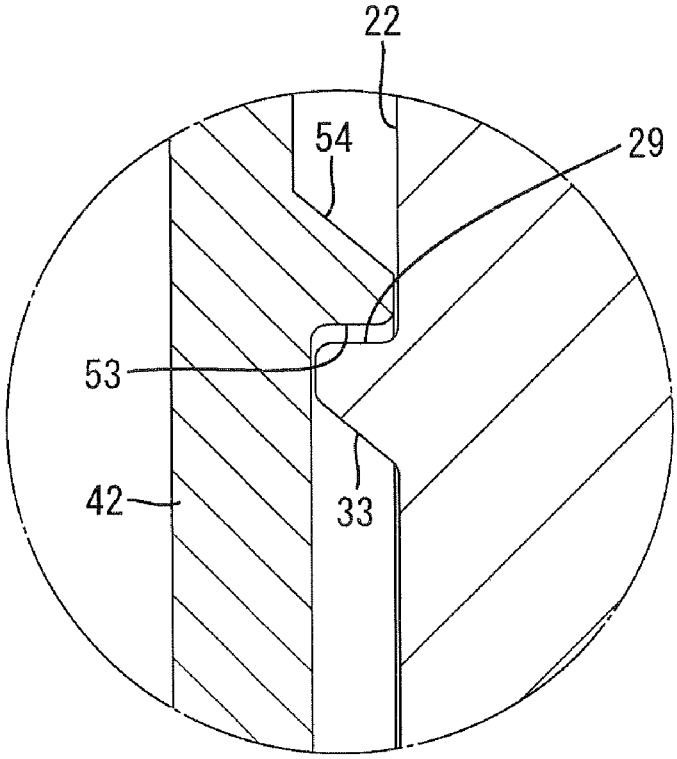
FIG. 8B is a sectional view taken along a line F-F of FIG. 4.

The upper edge of each side plate part 42 contacts the lower edge of the beam 31 and the front edge of each side plate part 42 contacts the rear edge of the protrusion 34 when the retainer 40 reaches the main locking position, as shown in FIG. 4, to prevent further forward movement of the retainer 40. The lower surface of the base part 41 becomes continuous and almost flush with the lower surface of the housing 10 when the retainer 40 has reached the main locking position, and the outer surfaces of the side plate parts 42 are continuous and almost flush with the respective side surfaces of the housing 10 (except the front and rear concavities 21 and 22). The to-be-locked portion 52 rides across the locking part 28 as the retainer 40 reaches the main locking position, as shown in FIG. 8B. As a result, both side plate parts 42 elastically return to their original state and the to-be-locked surface 53 is locked to the locking surface 29 to prevent the retainer 40 from returning toward the temporary locking position. At this time, the to-be-locked surface 53 and the locking surface 29 are locked to each other along surfaces that are inclined at an acute angle to the direction Z, which is perpendicular to the movement direction Y of the retainer 40 with respect to the fit-in direction X of the housing 10. As shown in FIG. 10, the lower and upper locking projections 45 and 46 achieve secondary locking of the terminal fittings 70 that have been inserted normally inserted into the cavities 11 and achieve a removal-prevented state. The mating housing then is fit on the housing 10 from the front with the housing 10 and the retainer 40 accommodated almost entirely in the mating housing.

A pulling force on the electric wires 90 that extend from the rear surface of the housing 10 exerts a removal force on the retainer 40 in the return direction thereof. Thus, there is a fear that the retainer 40 may return toward the temporary locking position or may be separated from the housing 10. However, the locking part 28 and the to-be-locked portion 52 are locked to each other at the main locking position along the locking surface 29 and the to-be-locked surface 53 that are inclined at an acute angle toward the direction Z, which is perpendicular to the movement direction Y of the retainer 40, and also at an acute angle to the fit-in direction X of the housing 10. This locking of the locking part 28 and the to-be-locked portion 52 to each other in the above-described direction is more resistant to the separation force applied to the retainer 40 than a mode of locking the locking part 28 and the to-be-locked portion 52 to each other along surfaces aligned with the fit-in direction X of the housing 10. Thus, the retainer 40 is not moved easily in the return direction and the locking part 28 and the to-be-locked portion 52 prevent the retainer 40 from being separated inadvertently from the housing 10.

The to-be-locked portion 52 is near the upper edges of the side plates 42 of the retainer 40 and inclines so that the distance between the to-be-locked portion 52 and the upper edge of each side plate part 42 gradually increases from the rear end of the to-be-locked portion 52 to the front end thereof. Thus the region 55 is formed between the upper edge of the to-be-locked portion 52 and the upper edge of the retainer 40. Therefore although the to-be-locked portion 52 is disposed near the upper edge of the retainer 40, the region 55 protects the to-be-locked portion 52 and enhances the strength thereof.

The locking part 28 is on the periphery of the side openings 19 formed through both side surfaces of the housing 10. Thus there is a fear that the locking part 28 is formed in a small region due to spatial limitation and that the to-be-locked portion 52 cannot be locked to the locking part 28 in a large area. However, the locking part 28 and the to-be-locked portion 52 are locked together in a direction that is not coincident with the direction Z perpendicular to the movement direction Y of the retainer 40 at the main locking position. Thus the above-described mode of locking the locking part 28 and the to-be-locked portion 52 together makes the region in which the locking part 28 is formed much larger than a mode of locking the locking part 28 and the to-be-locked portion 52 together along the direction Z perpendicular to the movement direction Y of the retainer 40. Accordingly, a large area is obtained for locking the locking part 28 and the to-be-locked portion 52 together.

The invention is not limited to the embodiments described above with reference to the drawings. For example, the following embodiments are included in the technical scope of the present invention.

Provided that the locking part-forming region is securely obtained, it is preferable to construct the housing and the retainer so that the locking part and the to-be-locked portion are locked to each other at the main locking position along the direction (oblique line in FIGS. 1 and 6) perpendicular to the movement direction of the retainer. This construction is capable of reliably preventing the to-be-locked portion from being unlocked from the locking part.

The retainer insertion hole may be formed to open through only one surface of the housing.

What is claimed is:

1. A connector comprising:

a housing having cavities extending along a fit-in direction and configured for receiving terminal fittings, the housing being formed with at least one locking part having a locking surface; and a retainer mounted on the housing and being movable in a movement direction oblique to the fit-in direction between a temporary locking position and a main locking position, the retainer being configured for allowing the terminal fittings to be inserted into the housing and removed therefrom when the retainer is at the temporary locking position, the retainer further being configured for preventing removal of the terminal fittings inserted into the housing when the retainer is at the main locking position, the retainer being formed with at least one to-be-locked portion having a locking surface that locks to the locking surface of the locking part when the retainer is at the main locking position, the locking surfaces of the locking part and the to-be-locked portion being aligned at an acute angle to the fit-in direction of the cavities and at an acute angle to the movement direction of the retainer wherein the retainer has a leading edge aligned parallel to the fit-in direction, the retainer further having front and rear ends spaced apart along the fit-in direction, the to-be-locked portion is disposed in proximity to the leading edge of the retainer, the to-be-locked portion inclining in a direction so that a distance between the to-be-locked portion and the leading edge of the retainer gradually increases from an end of the to-be-locked portion closer to the rear end of the retainer to an other end of the to-be-locked portion closer to the front end of the retainer.

2. The connector of claim 1, wherein the housing has a retainer insertion hole formed through a mounting surface of the housing confronting a direction in which the retainer is mounted on the housing and through two opposed side surfaces of the housing adjacent to the mounting surface thereof.

3. The connector of claim 2, wherein the retainer has a base and two opposed side plates projecting from opposite ends of the base, the side plates being configured for covering a portion of the retainer insertion hole formed through the side surfaces of said housing and parts of the side surfaces of the housing adjacent to the retainer insertion hole.

4. The connector of claim 3, wherein the at least one to-be-locked portion comprises two to-be-locked portions disposed on opposed facings surfaces of the respective side plates of the retainer; and the at least one locking part comprising two locking parts disposed respectively on the side surfaces of the housing at positions in proximity to the retainer insertion hole.

5. The connector of claim 1, wherein the locking surface of the locking part intersects a side surface of the housing along a line extending at an acute angle to the fit-in direction of the cavities and at an acute angle to the movement direction of the retainer.

6. A connector comprising:

a housing having opposite front and rear ends spaced apart along a fit-in direction, a mounting surface extending substantially along the fit-it direction and opposite side surfaces extending angularly from the mounting surface, cavities extending through the housing from the front end to the rear end along the fit-in direction and configured for receiving terminal fittings, a retainer insertion hole extending into the mounting surface and opening into portions of the side surfaces of the housing adjacent the mounting surface, the retainer insertion hole intersecting the cavities, locking parts formed respectively on the side surfaces, each of the locking parts having a locking surface; and a retainer mounted in the retainer insertion hole of the housing and being movable in a movement direction oblique to the fit-in direction between a temporary locking position and a main locking position, the retainer being offset from the cavities when the retainer is at the temporary locking position, the retainer projecting into the respective cavities when the retainer is at the main locking position, the retainer being formed with at least one to-be-locked portion in proximity to a leading end of the retainer relative to the moving direction, the to-be-locked portion inclining in a direction so that a distance between the to-be-locked portion and the leading edge of the retainer gradually increases from one end of the to-be-locked portion and an opposite end thereof, the to-be-locked portion having a locking surface that locks to the locking surface of the locking part when the retainer is at the main locking position, the locking surfaces of the locking part and the to-be-locked portion being aligned at an acute angle to the movement direction of the retainer and at an acute angle to the fit-in direction of the housing.

7. The connector of claim 6, wherein the retainer has a base and two opposed side plates projecting from opposite ends of the base, the side plates being configured for covering a portion of the retainer insertion hole formed through the side surfaces of said housing and parts of the side surfaces of the housing adjacent to the retainer insertion hole.

8. The connector of claim 6, wherein the locking surface of each of the locking parts intersects the respective side surface of the housing along a line extending at an acute angle to the moving direction of the retainer and at an acute angle to the fit-indirection of the housing.

* * * * *